US005495396A

United States Patent [19]

Mendick et al.

[11] Patent Number: 5,495,396

[45] Date of Patent: Feb. 27, 1996

[54] CIRCUIT BREAKER TRIP UNIT CONNECTOR CLIPS

[75] Inventors: Robin L. Mendick, Farmington; Ira B. Goldman, Waterbury, both of Conn.

[73] Assignee: General Electric Company, New York, N.Y.

[21] Appl. No.: 383,644

[22] Filed: Feb. 6, 1995

[51] Int. Cl.[6] ..... H01R 9/00; H01R 23/00

[52] U.S. Cl. ..... 361/772; 361/775; 439/637

[58] Field of Search ..... 218/1; 361/637–640, 361/772–776, 93, 94; 335/6–18, 195–202; 439/83, 629–637, 751, 862

[56] References Cited

U.S. PATENT DOCUMENTS

| | | | |
|---|---|---|---|
| 4,575,167 | 3/1986 | Minter | 439/83 |
| 4,728,914 | 3/1988 | Morris et al. | 335/6 |
| 4,884,048 | 11/1989 | Castonguay et al. | 335/18 |
| 5,082,459 | 1/1992 | Billman et al. | 439/637 |
| 5,204,798 | 4/1993 | Scott | 361/643 X |
| 5,232,379 | 8/1993 | Lai | 439/570 |
| 5,306,949 | 4/1994 | Yamada et al. | 361/772 |
| 5,387,133 | 2/1995 | Tondreault et al. | 439/637 |

*Primary Examiner*—J. R. Scott
*Attorney, Agent, or Firm*—Richard A. Menelly

[57] ABSTRACT

Collector clips arranged on a circuit breaker trip unit printed circuit board allow removable connection between the trip unit circuit and the circuit within a field-installable rating plug as well as other auxiliary electrical devices. The connector clips are oriented to the rating plug and the trip unit to prevent cold flow of the solder at the junction between the ends of the connector clips and the receiving holes formed within the trip unit circuit board.

9 Claims, 2 Drawing Sheets

CIRCUIT BREAKER TRIP UNIT CONNECTOR CLIPS

BACKGROUND OF THE INVENTION

U.S. Pat. No. 4,728,914 entitled "Rating Plug Enclosure for Molded Case Circuit Breaker" describes a removable and field-installable rating plug used to set the circuit breaker trip unit ampere rating. The rating plug includes a printed circuit board that supports the burden resistor that connects with the circuit breaker current transformers to generate a voltage signal proportionate to the sensed circuit current. Connection between the printed circuit board in the rating plug, hereafter "daughter board" and the electronic trip unit printed circuit, hereafter "mother board" is accomplished by means of hook-shaped clips upstanding from the mother board. U.S. Pat. No. 4,575,167 entitled "Electrical Connector for Printed Circuit Boards and the Like" describes one type of a connector clip used for removable connection with a printed circuit board. The clips are formed from an electrically conductive wire and are formed to the hook-shaped configuration after the wire drawing process. To prevent so-called "cold flow" between the ends of the clips and the solder pods used to attach the ends to the printed circuit board the ends are shaped to form a pair of oppositely facing offsets. It would be economically advantageous to eliminate the wire-drawing and shaping processes while still retaining the resistance to cold flow between the ends of the clips and the mother board solder pods.

One purpose of the invention is to fabricate printed circuit board connector clips from a simple metal stamping process that requires no additional wire shaping or forming to provide the correct configuration at the opposite ends of the clips.

SUMMARY OF THE INVENTION

Printed circuit board connector clips are formed by a single metal stamping process to provide a planar configuration having defined edges and sides. The sides are aligned within the mother board apertures so that the edges on opposing pairs of similar clips face each other. The "edge alignment" eliminates cold flow between the solder pods and the clips at the mother board connection while providing spring bias between the clips and the daughter board.

DESCRIPTION OF THE PREFERRED EMBODIMENT

Figure 1:
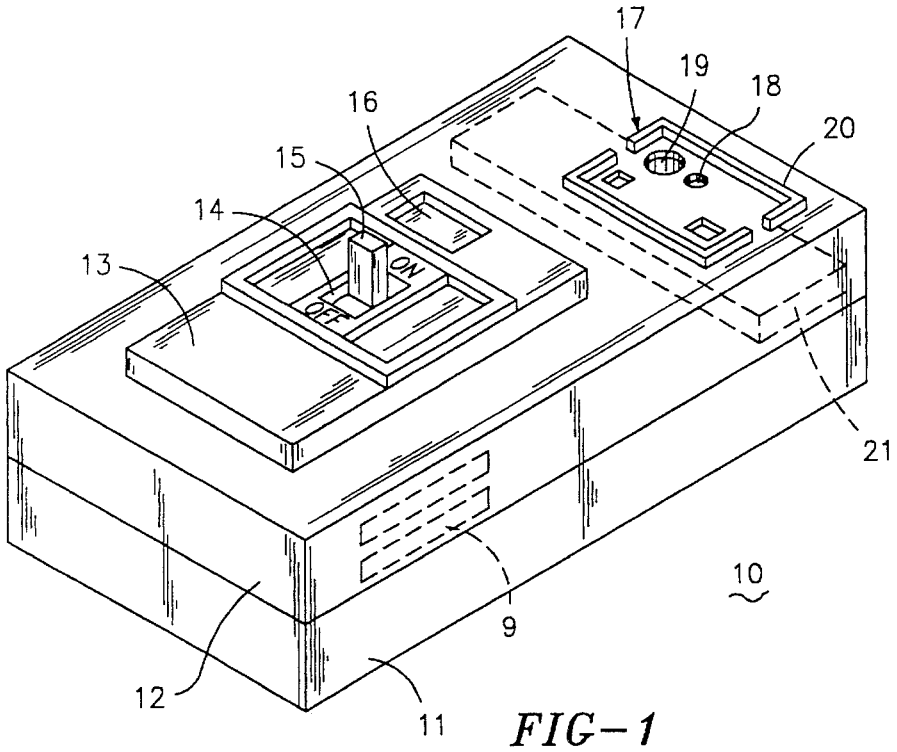
FIG. 1 is a top perspective view of a molded case circuit breaker employing the connector clips according to the invention.

The circuit breaker 10 shown in FIG. 1 is of the type including an insulative plastic case 11 joined by a similar insulating cover 12. The cover escutcheon 13 supports the access slot 14 through which the operating handle 15 protrudes. The indicator window 16 provides visual indication as to the ON, OFF and TRIPPED status of the circuit breaker contacts 9. As described within the aforementioned U.S. Pat. No. 4,728,914, a rating plug 17 including access openings 18, 19 is inserted within the rating plug recess 20 formed within the circuit breaker cover over the electronic trip unit printed circuit board 21.

Figure 2:
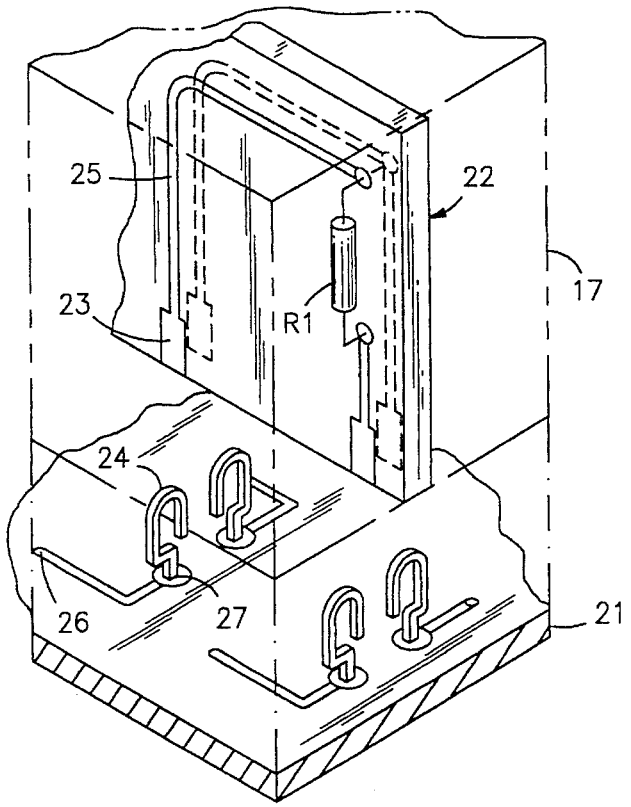
FIG. 2 is a top perspective view of the trip unit circuit board and the rating plug circuit board within the circuit board of FIG. 1, in partial section.

As best seen in FIG. 2, the rating plug 17, depicted in phantom, includes a rating plug circuit board 22 that supports the burden resistor R1 that sets the trip unit ampere rating. Electrical connection with the trip unit circuit board 21 is made by means of the connector clips 24 upstanding from the circuit board and the conductive pads 23 formed on the bottom of the rating plug circuit board 22. The conductive pads electrically connect with the remaining rating plug components by means of printed conductors 25. The connector clips 24 electrically connect with trip unit circuit board 21 by means of solder pods 27 and with the remaining trip unit components by means of the printed conductors 26.

Figure 3:
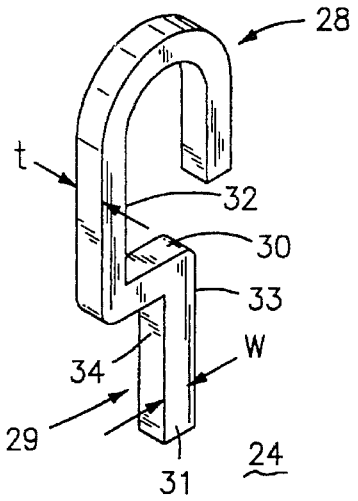
FIG. 3 is a front perspective view of the clip connector clip used with the trip unit circuit board of FIG. 2.
Figure 4:
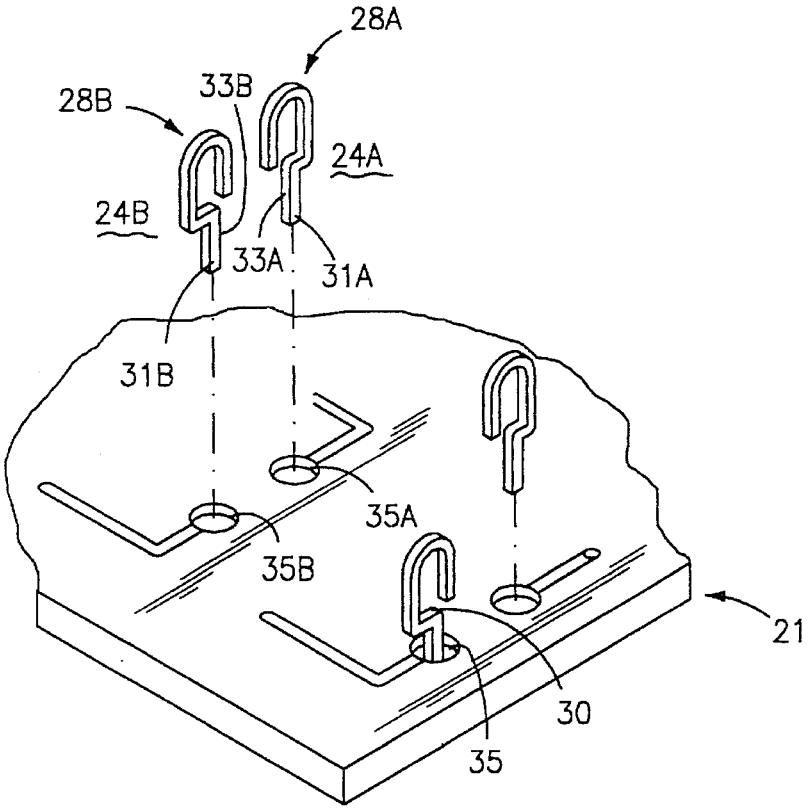
FIG. 4 is a top perspective view of the trip unit circuit board of FIG. 2 with the connector clips in isometric projection.

In accordance with the invention, the connector clips 24, shown in FIG. 3 are formed by metal stamping from a planar sheet of conductive metal having a thickness t that defines the thickness of the connector clip. The hook-shaped top part 28 provides connection with the rating plug circuit board of FIG. 2 while the linear bottom part 29 connects with the trip unit circuit board. The width w of the connector clip is at least twice the thickness t to provide resistance to cold flow between the end of the bottom part and the solder pod used to join the connector clip to the trip unit circuit board and to provide spring bias facility to the connector clip when the hook-shaped top part is displaced upon insertion of the rating plug circuit board. The stop 30 formed intermediate the hook-shaped top part 28 and the linear bottom part 29 abuts against the top of the opening 35 in the trip unit circuit board 21 as best seen by referring now to FIG. 4.

The opposing pair of connector clips 24A, 24B, shown prior to insertions with the corresponding openings 35A, 35B are oriented such that the corresponding edges 33A, 33B face each other so that the corresponding sides 31A, 31B are in parallel alignment. This is an important feature of the invention since the arrangement thereby provides return bias force to the opposing hook-shaped top parts 28A, 28B when the rating plug circuit board is inserted there between. Other auxiliary electrical devices that utilize a printed circuit board such as the trip actuator and power supply associated with the trip unit can also be connected with the printed circuit board connector clips.

An economical and functional connector clip arrangement has herein been described. The arrangement of the sides and edges of the connector clip insures captivation within the printed circuit board opening at one end of the connector clip while providing spring bias at the opposite end thereof.

We claim:

1. An electrical connector clip comprising:

a metal stamping defining a pair of opposing edges joined by a pair of opposing sides;

a hook-shaped configuration at one end of said stamping, said hook-shaped configuration arranged for receiving a first primed circuit board;

a linear configuration at an opposite end of said stamping, said linear configuration arranged for insertion and solder connection within openings formed in a second printed circuit board; and a stop formed within said stamping intermediate said hook-shaped configuration and said linear configuration, said stop arranged for abutting against a top part of said openings.

2. The electrical connector clip of claim 1 wherein said edges comprise a thickness t and said sides comprise a width w, said width being greater than said thickness to provide a bias force to said hook-shaped end.

3. The electrical connector clip of claim 3 wherein said width is at least twice said thickness.

4. A circuit breaker having variable ampere ratings comprising:

a molded plastic case;

a molded plastic cover attached to said case;

a pair of separable contacts within said case arranged for interrupting a protected electrical circuit;

a trip unit circuit board within said cover controlling open and closed conditions of said contacts, said trip unit circuit board including a plurality of connector clips, each of said clips comprising a metal stamping defining a pair of opposing edges joined by a pair of opposing sides;

a hook-shaped configuration at one end of said stamping, said hook-shaped configuration arranged for receiving an auxiliary printed circuit board;

a linear configuration at an opposite end of said stamping, said linear configuration arranged for insertion and solder connection within openings formed in said trip unit printed circuit board; and a stop formed within said stamping intermediate said hook-shaped configuration and said linear configuration, said stop arranged for abutting against a top part of said openings.

5. The circuit breaker of claim 4 wherein said edges comprise a thickness t and said sides comprise a width w, said width being greater than said thickness to provide a bias force to said hook-shaped end.

6. The circuit breaker of claim 5 wherein said width is at least twice said thickness.

7. The circuit breaker of claim 4 wherein said auxiliary printed circuit board comprises a rating plug printed circuit board.

8. The circuit breaker of claim 4 wherein said auxiliary printed circuit board comprises a power supply printed circuit board.

9. The circuit breaker of claim 4 wherein said auxiliary printed circuit board comprises a trip actuator printed circuit board.

* * * * *